US005448276A

United States Patent [19]

Hirabayashi et al.

[11] Patent Number: 5,448,276

[45] Date of Patent: Sep. 5, 1995

[54] INK JET PRINTER

[75] Inventors: Hiromu Hirabayashi; Hideo Yamazaki, all of Nagano, Japan

[73] Assignee: Seiko Epson Corporation, Tokyo, Japan

[21] Appl. No.: 162,315

[22] Filed: Dec. 7, 1993

[30] Foreign Application Priority Data

Dec. 7, 1992 [JP] Japan ..... 4-326910
Dec. 7, 1992 [JP] Japan ..... 4-326911

[51] Int. Cl.[6] ..... B41J 2/01
[52] U.S. Cl. ..... 347/103; 347/102
[58] Field of Search ..... 347/103, 102

[56] References Cited

U.S. PATENT DOCUMENTS 4,340,893 7/1982 Ort ..... 347/102
5,005,025 4/1991 Miyakawa et al. ..... 347/102
5,099,256 3/1992 Anderson ..... 347/103
5,372,852 12/1994 Titterington ..... 347/103 X

FOREIGN PATENT DOCUMENTS 0530627 3/1993 European Pat. Off. ..... B41J 2/005
9307000 4/1993 European Pat. Off. ..... B41J 2/005
3642204 6/1987 Germany ..... B41J 3/04

*Primary Examiner*—Joseph W. Hartary

*Attorney, Agent, or Firm*—Sughrue, Mion, Zinn, Macpeak & Seas

[57] ABSTRACT

An ink jet printer of the type in which an ink image is formed on an intermediate recording medium, and the ink image is transferred to a recording medium is disclosed. The ink jet printer includes heating means located near the intermediate recording medium. The heating direction of the heating means being set as desired. Control means is further included, which operates such that when the heating means heats the ink image formed on the intermediate recording medium, the heating direction of the heating means is set toward the intermediate recording medium at least one time, and when the heating means does not heat the intermediate recording medium, the heating direction of the heating means is put in the direction in which the heating means does not heat the recording head. The ink jet printer may also be constructed including heating means located near the intermediate recording medium, and select means for selecting a first heating direction in which the heating direction of the heating means is set toward the intermediate recording medium or a second heating direction in which the heating direction of the heating means is set toward the ink image transferred to the recording medium.

5 Claims, 5 Drawing Sheets

INK JET PRINTER

BACKGROUND OF THE INVENTION

1. Field of the Invention

The present invention relates to an ink jet printer. More particularly, the invention relates to an ink jet printer of the transfer type in which an ink image is first formed on an intermediate recording medium, and then transferred from the intermediate recording medium onto an image recording medium.

2. Prior Art Discussion

The transfer type ink jet printer is reliable in that it is free from the nozzle clogging problem arising from paper dust generated when the print heat comes in contact with a print paper. An example of this type of the printer is disclosed in Japanese Patent Laid-open Publication No. Hei. 1-226336.

In the construction of the transfer type ink jet printer, a print heat with a plural number of nozzles is disposed confronting with a tubular or drum-shaped intermediate recording medium, or a transfer drum. In the print operation of the printer, the print heat sets forth a jet of ink droplets toward the intermediate recording medium, thereby to depict an image on the intermediate recording medium. The image formed thereon is dried by a heater. An image recording medium, e.g., a print paper, is pressed against the image bearing surface of the intermediate recording medium, so that the ink image is transferred from the intermediate recording medium to the image recording medium. Accordingly, the ink image of the intermediate recording medium can be transferred without any deformation, and the transferred ink image will not blur on the printer paper. Thus,the pressure image transfer process, which thus causes no deterioration of print quality, can exactly transfer the ink image from the intermediate recording medium to the recording medium.

The study to find the causes of the nozzle clogging and improper discharge of ink from the print heat in the transfer type ink jet printer was made by the inventors of the present Patent Application. The study showed the fact that the heat left in the heater used for drying the ink image on the intermediate recording medium after the printer is continuously operated causes the nozzle clogging and instable ink discharge.

In the printer construction disclosed in the above patent publication, since the surface region of the intermediate recording medium is heated to dry the image formed thereon, heat is accumulatively stored in the heater with progress of the continuous operation of the printer. The heater, when having the accumulative storage of heat, continues the heating operation after the power supply to the heater is shut off, because the heater is conditioned for continuing the heating operation of the intermediate recording medium. Since the print heat is located in close proximity to the intermediate recording medium, it is excessively heated to cause water as main solvent of ink to evaporate through the nozzle openings. Consequently, the viscosity of the ink in the print heat increases. The sticky ink clogs the nozzles of the print head, and the discharge of ink from the nozzles is abnormal or irregular.

The conventional printer of the transfer type in which the dried ink image is transferred from the intermediate recording medium to a print paper was experimentally examined and analyzed. The results of the examination and analysis were as follows. 1) The pressure to transfer the image is excessive, so that the device size and the cost to manufacture are increased. 2) Attempt to reduce the image transfer pressure forms an insufficient solid ink image on the print head. That is, the ink image transferred onto the print paper is poor in water proof and wear proof.

In the construction of Japanese Patent Laid-open Publication No. Hei, 1-226336, the dried ink image on the intermediate recording medium becomes solid. However, a large pressure is required in order to secure a firm sticking of the ink image firmly to the print paper. Therefore, the printer must be designed so as to be able to apply a large pressure for image transfer.

To obtain an excellent transfer characteristic under a small pressure, the ink image on the transfer medium, when transferred, must be put in a semisolid state by drying the image. The ink image transferred on the print paper still contains a slight amount of water. Such an image, when touched with the finger, becomes blurred. Thus, the conventional techniques suffers from the problems of the wear and water proof. To improve the solidity of the transferred image, water must be completely removed from the transferred image. To this end, the print paper having the image printed thereon must be heated as in the conventional ink jet printer of the nontransfer type. In the printer construction having a first heating means for drying the ink image on the intermediate recording medium and a second heating means for completely removing water from the image transferred on the print paper, the heating rise time of the heating means used must be short, limiting freedom of selecting the heating means. In a case where the heating means of long heating rise time is used in this print construction and the first and second heating means are operated in a continuous manner, a situation where both the heating means are in an ON state takes place inevitably. In this situation, temperature within the printer rises excessively, and the print heat is also overheated. Water of the ink in the print heat evaporates, the nozzles of the print head are possibly clogged with dried ink, and jets of ink droplets are irregularly and abnormally discharged from the nozzles of the print head.

SUMMARY OF THE INVENTION

With the view of solving the problems as stated above, the present invention has an object to provide an ink jet printer which can smoothly and stably discharge jets of ink droplets, without an excessive temperature rise of the print head and the clogging of the nozzles of the print head.

Another object of the present invention is to provide a transfer type ink jet printer which can eliminate an overheat of the print head if any type of the heating means is used, thereby realizing a stable discharge of jets of ink by the print head.

Yet another object of the present invention is to provide a transfer type ink jet printer which can transfer an ink image from an intermediate recording medium onto a recording medium under a low pressure, thereby forming the ink image of good solidity on the recording medium.

According to the present invention, there is provided an ink jet printer of the type in which an ink image representative of input information is formed on an intermediate recording medium by discharging jets of ink droplets from a print head toward the intermediate recording medium, and the ink image is transferred to a recording medium, the ink jet printer comprising: heating means located near the intermediate recording medium, the heating direction of the heating means being set as desired; and control means operating such that when the heating means heats the ink image formed on the intermediate recording medium, the heating direction of the heating means is set toward the intermediate recording medium at least one time, and when the heating means does not heat the intermediate recording medium, the heating direction of the heating means is put in the direction in which the heating means does not heat the print head.

Thus, in the ink jet printer, when the heating means heats the ink image formed on the intermediate recording medium, the heating direction of the heating means is set toward the intermediate recording medium at least one time. When the heating means does not heat the intermediate recording medium, the heating direction of the heating means is put in the direction in which the heating means does not heat the recording head. Therefore, the problems of the excessive temperature rise in the recording head and the nozzle clogging are solved. A stable discharge of jets of the ink droplets is realized.

According to another aspect of the present invention, there is provided an ink jet printer of the type in which an ink image representative of input information is formed on an intermediate recording medium by discharging jets of ink droplets from a print head toward the intermediate recording medium, and the ink image is transferred to a recording medium, the ink jet printer comprising: heating means located near the intermediate recording medium; and select means for selecting a first heating direction in which the heating direction of the heating means is set toward the intermediate recording medium or a second heating direction in which the heating direction of the heating means is set toward the ink image transferred to the recording medium.

In the above two constructions of ink jet printer of the present invention, when the heating means heats the ink image formed on the intermediate recording medium, the heating direction of the heating means coincides with the first heating direction at least one time, and when the heating means heats the ink image transferred to the recording medium, the heating direction of the heating means coincides with the second heating direction at least one time.

When the recording head heats the ink image formed on the intermediate recording medium, the heating means is set in the first heating direction to dry the ink image on the intermediate recording medium till the ink image becomes semisolid. When the heating means heats the ink image transferred to the recording medium, the heating means completely dries the ink image thereon to fix the ink image onto the recording medium. Therefore, the heating operations can be successively carried out irrespective of the type of the heating means. This construction of the printer suppresses an excessive increase of the temperature of the recording head, thereby eliminating the nozzle clogging and ensuring a stable discharge of ink jets. Further, the image transfer from the intermediate recording medium to the recording medium can be carried out under a low pressure. The image formed on the recording medium is solid or excellent in water and wear proof.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

The construction of an ink jet printer according to a first embodiment of the present invention will be described with reference to FIGS. 1 through 5.

Figure 1:
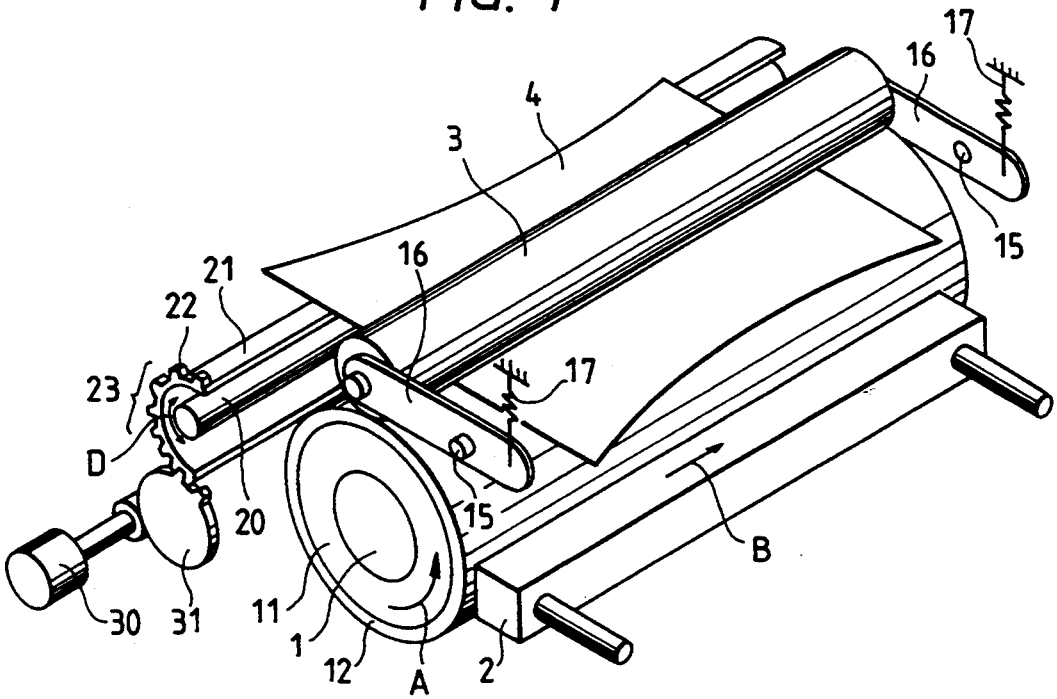
FIG. 1 is a perspective view showing a first embodiment of an ink jet printer according to the present invention.
Figure 2:
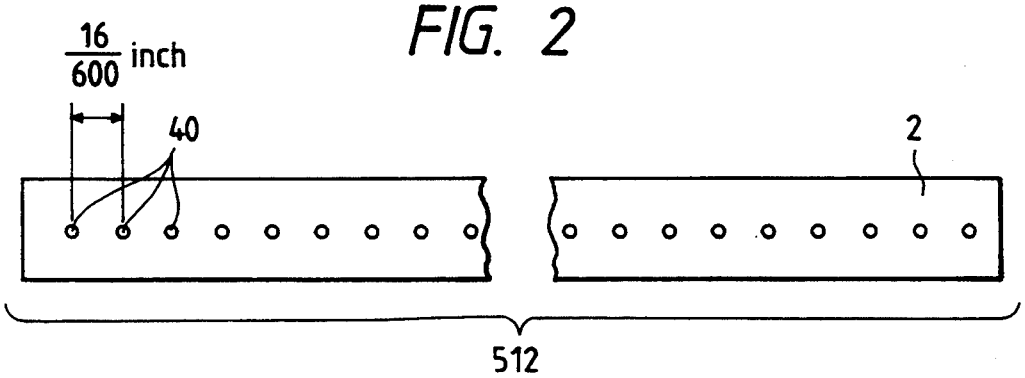
FIG. 2 is a plan view showing the nozzle plate of a print heat of the ink jet printer shown in FIG. 1.

An ink jet recording or print head 2, based on a piezolelectric element, includes a number of nozzles 40 equidistantly arrayed in the axial direction of an intermediate recording medium taking the form of a transfer drum 1 (FIGS. 1 and 2). More specifically, in this embodiment, 512 number of nozzles 40 are linearly arrayed at the pitches of 16/600 inches. The print head 2 moves a distance of 1/600 inches in the direction of an arrow B every time the transfer drum 1 is rotated by one turn in the direction of an arrow A (FIG. 1).

Ink used contains at least water, water-soluble organic solvent, pigment, and colloidal dispersion resin. More exactly, in the compositions of the ink, the pigment is carbon black of 3 wt %, the colloidal dispersion resin is water sol CD-540 (containing resin solid content 40% and isopropylene glycol 13%) of 30 wt %, the water-soluble organic solvent is triethanolamine of 5 wt %, humectant is triethylene glycol of 5 wt %, and pure water. The water sold CD-540 is expoxy ester colloidal dispersion made by DAI NIHON INK corporation (Japan). The solid-contents of the ink indicates carbon black as the pigment and colloidal dispersion resin. The particle diameter of the solid-contents is 1 $\mu$or less in the stage of manufacturing ink.

The transfer drum 1 includes a metal tube 11 and an elastic layer 12, layered on the tube, made of silicone rubber. In this embodiment, the diameter of the transfer drum 1 of $\phi$80 mm. The elastic layer 12 is preferably a rubber material from which the ink image is easily peeled, such as silicone rubber, fluorosilicone rubber, fluororubber, hydrogenated nitrile rubber, or silicon rubber incorporating surface-active agent thereinto.

To facilitate the evaporation of water from the ink image on the transfer drum 1 to quicken the drying operation of the ink image, a heating means 23 is provided, which includes a heater lamp 20 as a bar-like halogen lamp and a reflector 21 for fixing the heating direction. In the heater lamp 20, a temperature on the surface of the elastic layer 12 is sensed by a sensor, not shown, and the lamp is intermittently lit on according to the sensed temperature. Through the intermittent light-on of the lamp, the evaporation of water from the ink image on the transfer drum 1 is controlled so that the surface temperature falls within a preset range of temperature. By the temperature control, the ink image on the drum 1 is dried to be in a semisolid state. In this embodiment, the surface temperature is kept at approximately 50° C. The end part of the reflector 21 is profiled to have a tooth form 22. A drive force of a motor 30 is transmitted through a gear 31 to the tooth form 22. With this mechanism, the reflectors 21 is turned in the direction of an arrow D. More specifically, the reflector 21 is selectively set at desired positions, through the operation of the motor 30. In this embodiment, it may be set at three fixed positions defining heating directions. At the first position, the heating direction of the heating means 23 is set to the shaft of the transfer drum 1, viz., it coincides with the direction of an arrow S in FIG. 3. At the second position,the heating direction of the heating means 23 is put toward the ink image printed on a print paper 4 as a recording medium, viz., it coincides with the direction of an arrow T in FIG. 4. At the third position, the heating direction is set in the direction opposite to the print head 2, viz., it coincides with the direction of an arrow U in FIG. 5.

In order to transfer an ink image from the transfer drum 1 to the print paper 4, a back-up roller 3 is provided which functions to press the print paper 4 against the transfer drum 1. The back-up roller 3 is swung about a fulcrum 15 to and apart from the transfer drum 1 by means of a press lever 16. The pressure force is controlled by a spring 17, and set at 0.28 to 0.6 kg/cm in this embodiment.

The operation of the ink jet printer will be described.

Figure 3:
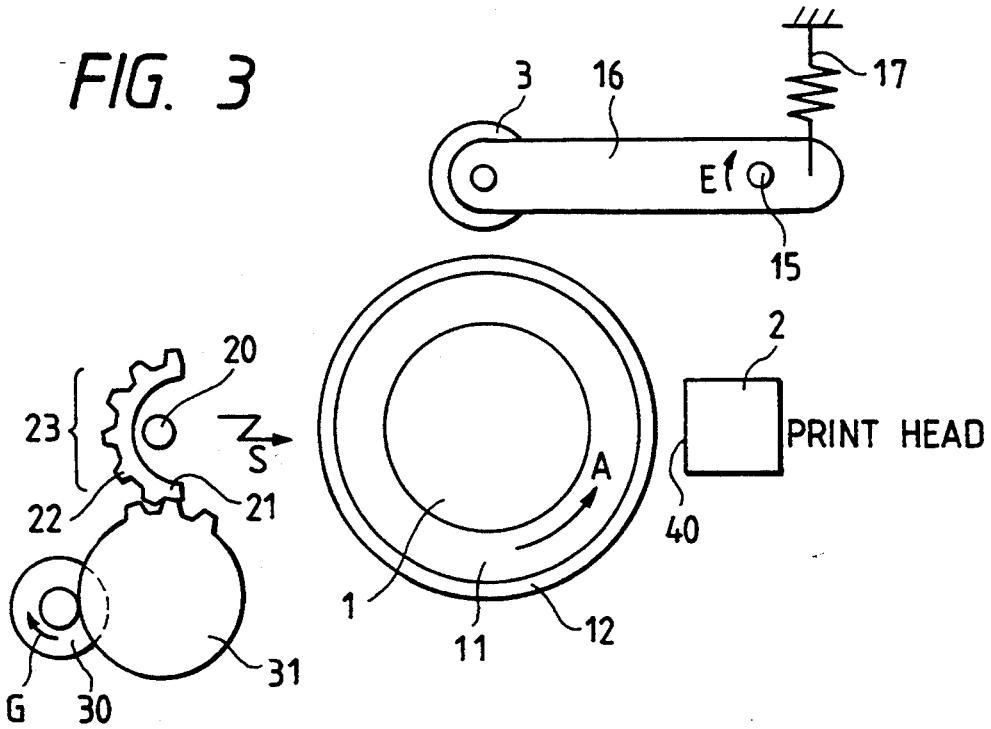
FIG. 3 is a cross sectional view showing a state of the ink jet printer when an ink image is formed on a transfer drum.

FIG. 3 is a cross sectional view showing a state of the ink jet printer when an ink image is formed on the transfer drum 1 by selectively discharging jets of ink droplets from the nozzles 40 of the print head 2. In the illustration of FIG. 2, the press lever 16 has been turned about the fulcrum 15 in the direction of an arrow E. Accordingly, the back-up roller 3 is detached from the transfer drum 1. Further, the motor 30 has been turned in the direction of an arrow G. Accordingly, the heating direction of the heating means 23 coincides with the heating direction S toward the shaft of the transfer drum 1. That is, the reflector 21 is set at the first position.

In this embodiment, the print head 2 includes 512 number of nozzles 40 at the pitches of 16/600 inches. Accordingly, every time the transfer drum 1 is turned one time in the direction of an arrow A, ink images of 512 lines are formed at the pitches of 16/600 inches on the transfer drum 1. The heater lamp 20 of the heating means 23 is intermittently light on so that the surface temperature of the elastic layer 12 falls within a preset range. Through the heating operation, water is evaporated from the ink images, so that the ink images on the transfer drum 1 are placed in a semisolid state. When the transfer drum 1 is rotated by one turn, the print head 2 is moved a distance of 1/600 inches in the direction B in FIG. 1. Thereafter, the second turn of the transfer drum 1 starts. As in the first turn of the transfer drum 1, ink images of 512 lines at the pitches of 16/600 inches are formed in a semisolid state at the location adjacent to the ink images formed in the first turn of the transfer drum 1. 16 turns of the transfer drum 1 completes the formation of an image of one page in a semisolid state. Itisnoted here that the back-up roller 3 will never come in contact with the surface of the transfer drum 1 during the image formation. Accordingly, the successively formed ink images are not damaged by the roller, securing a high image quality of the image on the transfer drum 1.

Figure 4:
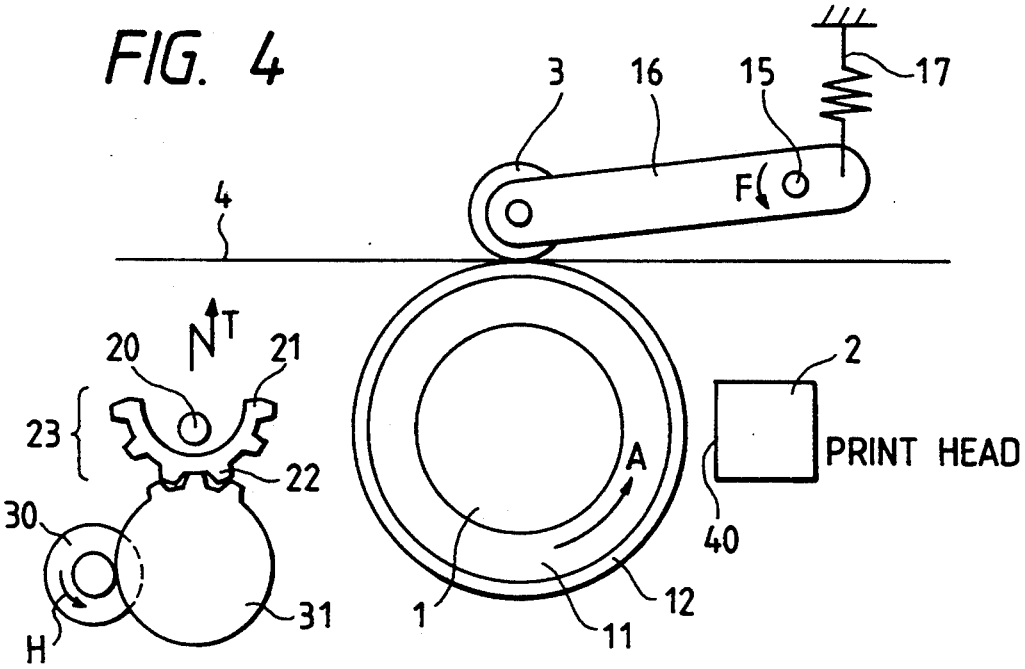
FIG. 4 is a cross sectional view showing a state of the ink jet printer when the transfer operation of the ink image from the transfer drum to a print paper starts.

FIG. 4 is a cross sectional view showing a state of the ink jet printer when the transfer operation of the semisolid ink image from the transfer drum 1 to the print paper 4 starts. As shown, the press lever 16 has been turned about the fulcrum 15 in the direction of an arrow F. The back-up roller 3 is pressed against the transfer drum 1 by means of the spring 17. Further, with the turn of the motor 30 in the direction of an arrow H, the heating direction of the heating means 23 coincides with the heating direction T set toward the ink image on the print paper 4. That is, the reflector 21 is set at the second position.

Thus, the semisolid ink image on the transfer drum 1 is transferred and attached to the print paper 4 in a semisolid state in a manner that the back-up roller 3 and the transfer drum 1 nip the print paper 4 therebetween with the aid of the spring 17. With rotation of the transfer drum 1, the print paper 4 moves, so that the ink image is peeled off the elastic layer 12 of the transfer drum 1. Thereafter, the heating means 23 dries the ink image till it becomes solid state. Here, the fixing of the ink image on the print paper 4 completes.

An urging force of the spring 17 necessary for the image transfer is determined by a dried state of the ink image formed on the transfer drum 1. When the ink image on the transfer drum 1 is completely dried and in a solid state, the bonding force between the ink image on the transfer drum 1 and the elastic layer 12 is very strong. Under this condition, a high transfer pressure is required, and an improper transfer takes place frequently. On the other hand, in this embodiment, the ink image on the transfer drum 1 is dried to be in a semisolid state. Accordingly, the bonding force between the ink image on the transfer drum 1 and the elastic layer 12 is decreased, while the bonding force between the ink image and the print paper 4 is increased. As a result, the ink image can be transferred to the print paper 4 under a low transfer pressure, with a reduced residua of the ink image on the transfer drum 1.

Since the ink image transferred on the print paper is still semisolid, it is easily blurred when it is touched with the finger. That is, the image on the print paper is poor in the water and wear proof. To cope with this, this embodiment operates the heating means 23 to dry the semisolid image on the print paper 4 till it becomes solid.

Figure 5:
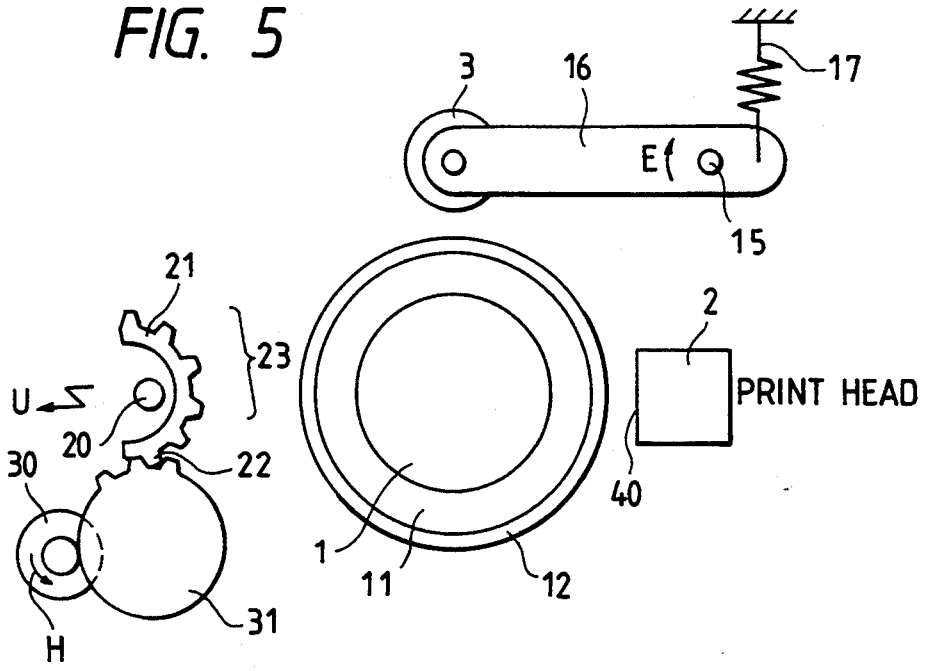
FIG. 5 is a cross sectional view showing a state of the ink jet printer when the ink jet printer is ready for the next printer operation.

FIG. 5 is a cross sectional view showing a state of the ink jet printer when the ink jet printer is ready for the next print operation after the print paper 4 bearing the image transferred and fixed thereto is discharged. As shown, the press lever 16 has been swung in the direction of an arrow E about the fulcrum 15. The back-up roller 3 disengages from the transfer drum 1. Further, the motor 30 has been turned in the direction of the arrow H. The reflector 21 is directed in the direction opposite to the print head 2, or set at the third position.

After a continuous print operation, heat has been accumulatively stored in the heating means 23 after it heats the ink image formed on the transfer drum 1 or the ink image transferred on the print paper 4. Under this condition, the heating means 23 continues the radiation of heat, viz., the heat left therein even after the power supply to the heating means 23 is shut off. In this case, if the heating direction is set to the direction for heating the print head 2, viz., the reflector 21 is directed toward the shaft of the transfer drum 1, the remaining heat in the heating means 23 continuously heats the surface of the transfer drum 1. As a result, the temperature of the print head 2 continuously rises because an extremely small space (approximately 0.5 mm to 1 mm in this embodiment) is present between the transfer drum 1 and the print head 2. Under this condition, water as main solvent of the ink within the print head 2 continues the evaporate. The viscosity of the ink starts to increase within the print head 2. Consequently, the clogging of the nozzles of the print head 2 and an improper discharge of ink jets from the nozzles take place frequently. It is noted here that in this embodiment, the heating direction is set to the direction of the arrow U, viz., the direction opposite to the print head 2 (FIG. 5). Therefore, the transfer drum 1 and the print head 2 are not continuously heated by the remaining heat of the heating means 23. The problems of the nozzle clogging and improper ink discharge are successfully solved.

Figure 6:
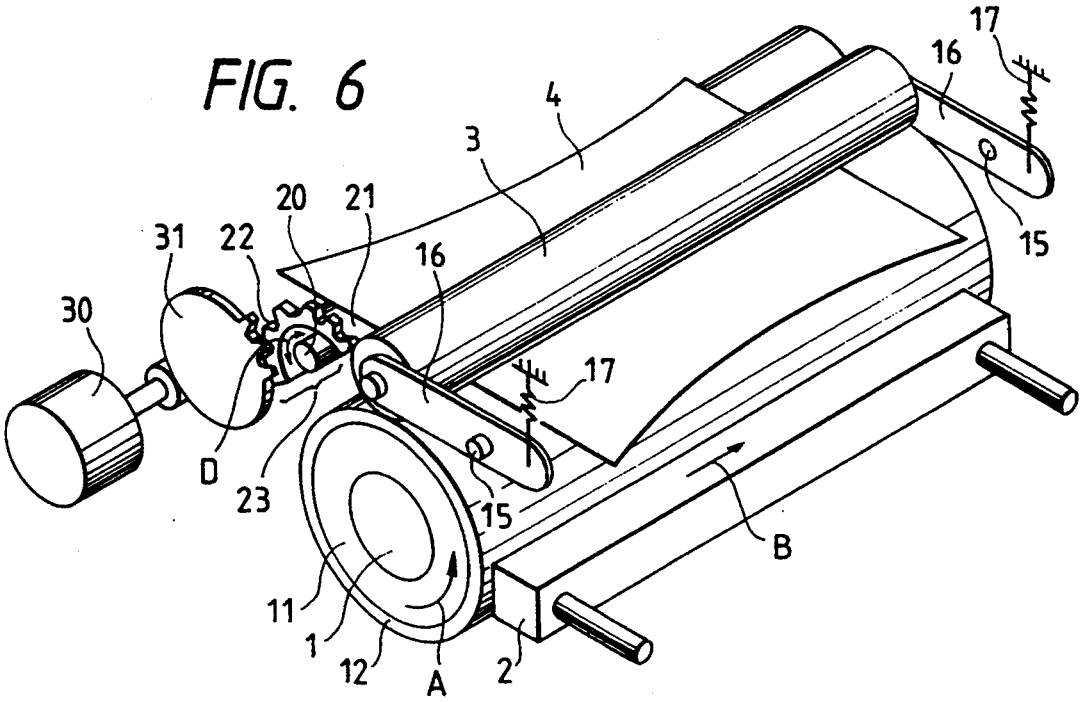
FIG. 6 is a perspective view showing a second embodiment of an ink jet printer according to the present invention.
Figure 7:
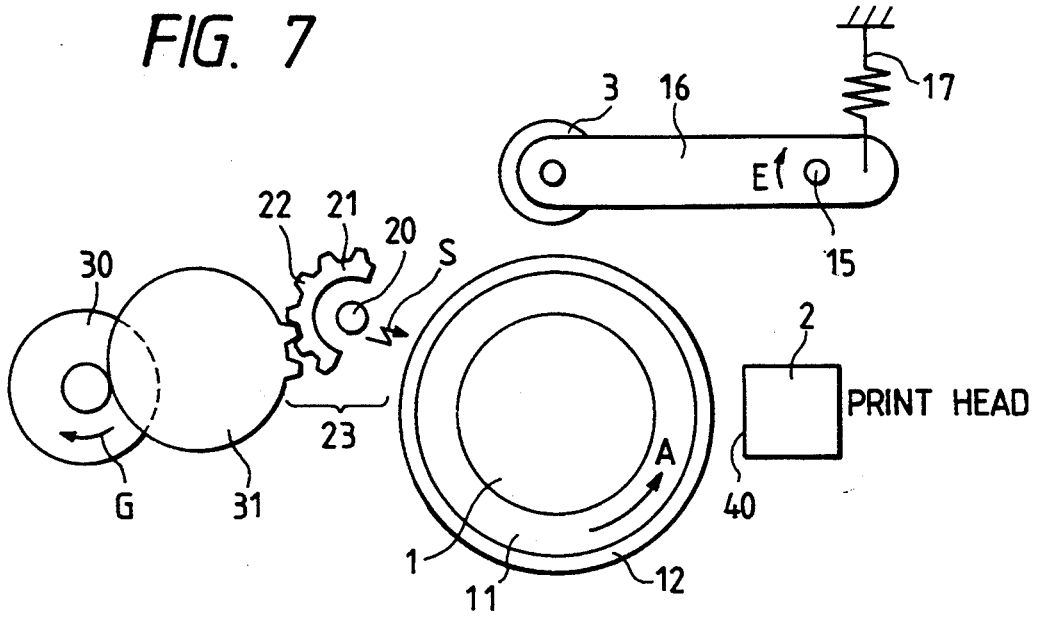
FIG. 7 is a cross sectional view showing a state of the ink jet printer when an ink image is formed on a transfer drum.
Figure 8:
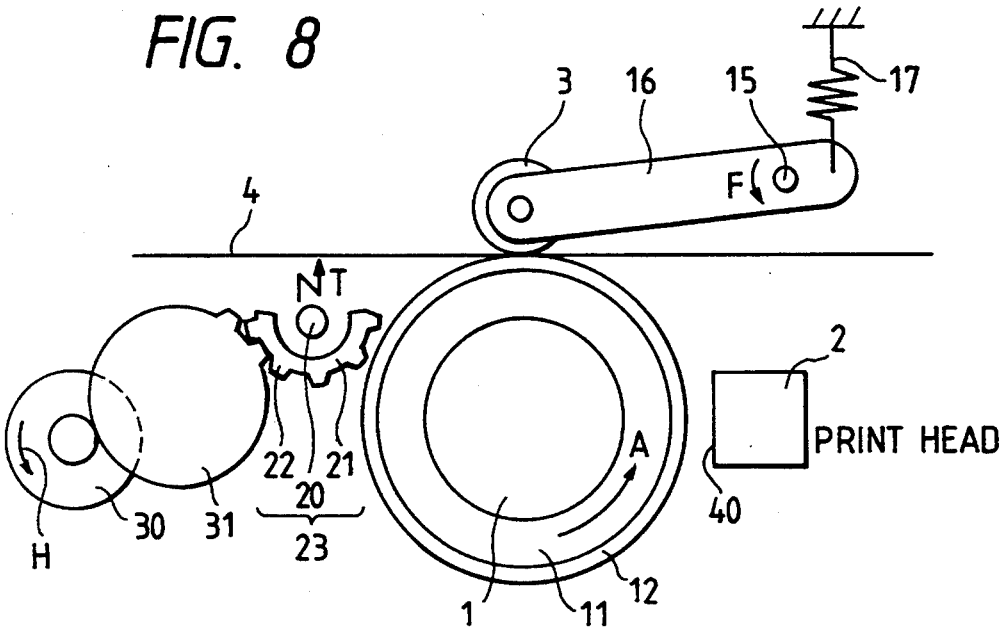
FIG. 8 is a cross sectional view showing a state of the ink jet printer when the transfer operation of the ink image from the transfer drum to a print paper starts.

The construction of an ink jet printer according to a second embodiment of the present invention will be described with reference to FIGS. 6 through 8.

In the second embodiment of the invention, the reflector 21 is fixed at two positions, a first heating position, and a second heating position. At the first heating position, the heating direction of the heating means 23 is put toward the shaft of the transfer drum 1, that is, it coincides with the direction of an arrow S in FIG. 7. At the second heating position, the heating direction is put toward the ink image transferred to the print paper 4 as the recording medium, that is, it coincides with the direction of an arrow T in FIG. 8.

With this structure, when the ink image formed on the intermediate recording medium, or the transfer drum 1, is heated, the heating means 23 heats the transfer drum 1 at least one time. When the ink image transferred on the recording medium, or the print paper 4, is heated, the heating means 23 heats the print paper 4 at least one time.

The remaining construction and operation of the printer are substantially the same as those of the ink jet printer of the first embodiment. Hence, no further description will be given here.

To quicken the printing operation of one sheet of print paper, an ink image forming step and a transfer-fixing step must be performed successively. The ink image forming step forms an ink image on the transfer drum 1 by the print head 2 and dries the ink image till it becomes semisolid. The transfer/fixing step transfers the ink image from the transfer drum 1 to the print paper 4, and fixes the ink image to the print paper 4 by drying the ink image completely. In the printer construction using two heating means, one for heating the ink image on the transfer drum 1 till it becomes semisolid and the other for heating the ink image transferred on the print paper 4 till it becomes solid, the heating means of a quick temperature rise time must be used. Accordingly, freedom of selecting the heating means is limited. If the heating means of a slow temperature rise is used, and the heating means for the ink formation step and another heating means for the transfer/fixing step are successively operated, concurrent operation of both the heating means is inevitable because the loss of the heating rise time must be removed. When both the heating means concurrently operate, temperature within the printer increases excessively, and the print head is also overheated. Under this condition, water of the ink in the print head evaporates, leading to clogging of the nozzles and improper discharge of ink.

In the second embodiment, the end part of the reflector 21 is profiled to have a tooth form 22. A drive force of a motor 30 is transmitted through a gear 31 to the tooth form 22. With this mechanism, the reflector 21 is turned in the direction of an arrow D shown in FIG. 6. More specifically, the heating direction of the heating means 23 may be selectively set to one of the two heating directions, the first heating direction S toward the shaft of the transfer drum 1 (FIG. 7) and the second heating direction T toward the ink image transferred to the print paper 4 (FIG. 8). Accordingly, the operation of drying the ink image on the transfer drum 1 and the operation of drying the ink image on the print paper 4 can be carried out by the heating means 23 in a successive manner. With this feature, the heating means of slow temperature rise may be used for the heating means 23. An increased number of the heating means are available for the heating means 23 in the ink jet printer of the invention. Further, the single heating means 23 covers the ink formation step and the transfer/fixing step, causing no temperature rise within the printer. Additionally, because of the use of the halogen lamp for the heater lamp 20 as the heat source, only the ink image can be effectively heated without an excessive temperature rise of the transfer drum 1 and the print paper 4.

Figure 9:
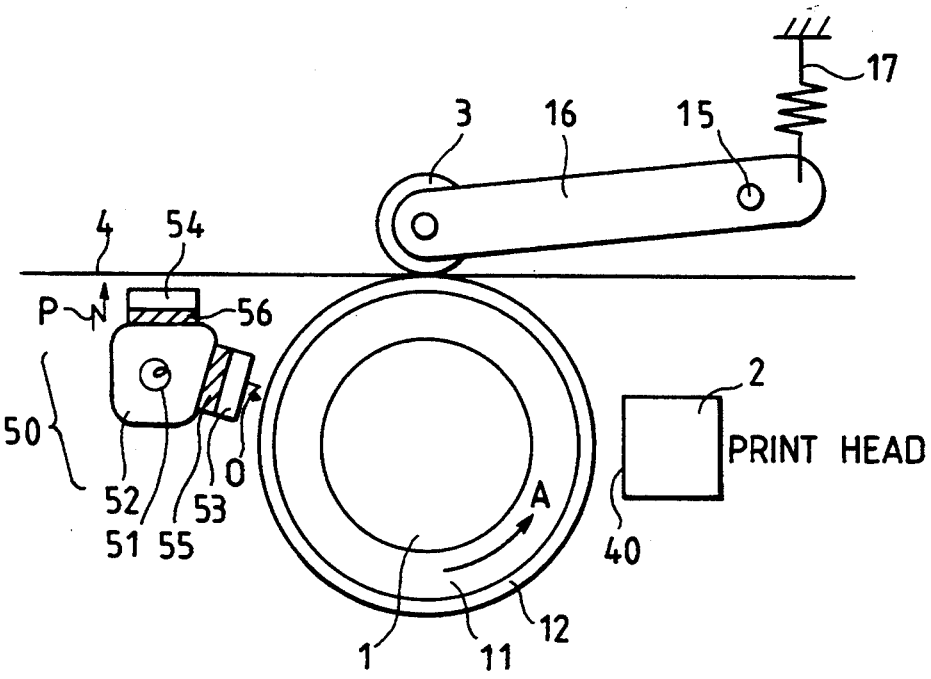
FIG. 9 is a cross sectional view showing a third embodiment of an ink jet printer according to the present invention.

FIG. 9 is a cross sectional view showing a third embodiment of an ink jet printer according to the present invention.

A heating means 50 is made up of a hot air fan 52 using a electric heater 51, a duct 53 with a blow-off port directed toward the shaft of the transfer drum 1, and a duct 54 with a blow-off port directed toward the ink image transferred on the print paper 4. Reference numerals 55 and 56 designate valves for controlling the open/close of the ducts 53 and 54.

To heat the ink image that is formed on the transfer drum 1 by the print head 2, the valve 55 is opened and the valve 56 is closed. Hot air is blow out of the duct 53 of the heating means 50 in the direction of an arrow O. The hot air blown out heats the surface of the transfer drum 1 to dry the ink image on the transfer drum 1 till it becomes semisolid. To heat the ink image transferred to the print paper 4, the valve 55 is closed and the valve 56 is opened. Hot air is blown out of the duct 54 of the heating means 50 in the direction of an arrow P. It heats the surface of the ink image on the print paper 4 till it becomes solid. By exhausting hot air through the ducts 53 and 54 outside the ink jet printer, temperature and humidity within the printer can be kept constant eliminating the nozzle clogging and realizing the stable ink discharge from the nozzles.

The remaining construction and operation of the third embodiment are substantially the same as those of the first and second embodiment. Reference is made to the related descriptions in the specification.

In the construction of the heating means employed in any of the embodiments as mentioned above, the heating direction of the reflector 21 or the selection of the duct 53 or 54 is controlled without moving the heat source per se for heating the ink image on the transfer drum 1 and the ink image transferred on the print paper 4. This construction leads to construction simplification and cost reduction. It is further noted that the heat source is not in contact with the print paper 4. With this construction, no paper jamming takes place, ensuring a safety of the printer.

As described above, in the ink jet printer of the invention, heating means is located near the intermediate recording medium. The heating direction of the heating means is set as desired. Control means further provided operates such that when the heating means heats the ink image formed on the intermediate recording medium, the heating direction of the heating means is set toward the intermediate recording medium at least one time, and when the heating means does not heat the intermediate recording medium, the heating direction of the heating means is put in the direction in which the heating means does not heat the recording head. Therefore, the problems of the excessive temperature rise in the recording head and the nozzle clogging are solved. A stable discharge of jets of ink droplets is realized.

In another ink jet printer of the invention, heating means is located near the intermediated recording medium. Select means further provided functions to select a first heating direction in which the heating direction of the heating means is set toward the intermediate recording medium or a second heating direction in which the heating direction of the heating means is set toward the ink image transferred to the recording medium. Therefore, Irrespective of the type of the heating means, this construction of the printer suppresses an excessive increase of the temperature of the recording head, thereby eliminating the nozzle clogging and ensuring a stable discharge of ink jets. Further, the ink image formed on the recording medium is dried, by the heating means, till it becomes semisolid, and subsequently it is transferred to the recording medium by means of the back-up roller. Accordingly, the image transfer from the intermediate recording medium to the recording medium can be carried out under a low pressure. The image formed on the recording medium is solid or excellent in water and wear proof.

What is claimed is:

1. An ink jet printer of the type in which an ink image representative of input information is formed on an intermediate recording medium by discharging jets of ink droplets from a print head toward the intermediate recording medium, and the ink image is transferred to a recording medium, said ink jet printer comprising:

heating means located near said intermediate recording medium, the heating direction of said heating means being set as desired; and control means operating such that when said heating means heats the ink image formed on said intermediate recording medium, the heating direction of said heating means is set toward said intermediate recording medium at least one time, and when said heating means does not heat said intermediate recording medium, the heating direction of said heating means is put in the direction in which said heating means does not heat said print head.

2. An ink jet printer of the type in which an ink image representative of input information is formed on an intermediate recording medium by discharging jets of ink droplets from a print head toward the intermediate recording medium, and the ink image is transferred to a recording medium, said ink jet printer comprising:

heating means located near said intermediate recording medium; and select means for selecting a first heating direction in which the heating direction of said heating means is set toward said intermediate recording medium or a second heating direction in which the heating direction of said heating means is set toward the ink image transferred to said recording medium.

3. The ink jet printer according to claim 2, in which when said heating mean heats the ink image formed on said intermediate means coincides with said first heating direction at heating means coincides with said first heating direction at least one time, and when said heating means heats the ink image transferred to said recording medium, the heating direction of said heating means coincides with said second heating direction at least one time.

4. The ink jet printer according to claim 1 or 2, in which said heating means includes a heater lamp and a reflector that may be turned about the axis of said heater lamp, and said selected means includes a tooth profile of the end part of said reflector, and a gear in mesh with said tooth profile.

5. The ink jet printer according to claim 2, in which said heating means includes a hot air fan for blowing hot air, a first duct for guiding the hot air toward said intermediate recording medium, and second duct for guiding the hot air toward said recording medium, and said select means includes valves respectively associated with said first and second ducts.

* * * * *